United States Patent [19]

Ott

[11] Patent Number: 4,750,984

[45] Date of Patent: Jun. 14, 1988

[54] METHOD OF PRODUCING ASPHALT

[76] Inventor: Clifford J. Ott, 10315 Tolman, Houston, Tex. 77034

[21] Appl. No.: 798,939

[22] Filed: Nov. 18, 1985

[51] Int. Cl.[4] ..... C10C 3/02

[52] U.S. Cl. ..... 208/39; 208/44; 208/24; 208/27; 208/40; 106/273 R; 106/274

[58] Field of Search ..... 208/39, 44; 106/273, 106/274

[56] References Cited

U.S. PATENT DOCUMENTS

| | | | |
|---|---|---|---|
| 1,669,490 | 5/1928 | Savage | 208/44 |
| 1,720,487 | 7/1929 | Lichtenstein | 208/44 |
| 1,745,155 | 1/1930 | Faber et al. | 208/44 |
| 2,220,714 | 11/1940 | Hersberger | 196/74 |
| 2,272,866 | 2/1942 | Burk et al. | 208/44 |
| 2,690,418 | 9/1954 | Young et al. | 208/39 |
| 3,317,447 | 5/1967 | Black et al. | 208/44 |
| 3,839,190 | 10/1974 | Frese et al. | 208/22 |
| 3,919,072 | 11/1975 | Pitchford et al. | 208/39 |
| 3,960,585 | 6/1976 | Gaw | 208/22 |
| 4,024,076 | 5/1977 | Miyake et al. | 208/44 |
| 4,225,353 | 9/1980 | Beaudoin et al. | 106/274 |
| 4,239,547 | 12/1980 | McBee et al. | 106/274 |
| 4,242,246 | 12/1980 | Maldonado et al. | 106/274 |
| 4,283,230 | 8/1981 | Clementoni et al. | 208/44 |
| 4,283,231 | 8/1981 | Clementoni et al. | 106/274 |
| 4,298,397 | 11/1981 | Burris | 106/274 |
| 4,440,579 | 4/1984 | Eidem | 106/274 |
| 4,559,128 | 12/1985 | Goodrich | 208/39 |

*Primary Examiner*—Helen M. S. Sneed
*Assistant Examiner*—Helane Myers
*Attorney, Agent, or Firm*—Baker, Kirk & Bissex

[57] ABSTRACT

A method of producing high quality, homogenous asphalt comprising the steps of mixing and heating a hydrocarbon feedstock not normally suited for asphalt production with elemental sulfur and agitating the resulting mixture. A halide catalyst may be added to the mixture to promote the reaction of the hydrocarbon feedstock with the sulfur. If desired, the agitated mixture may be air blown in any conventional manner to increase its hardness.

5 Claims, No Drawings

METHOD OF PRODUCING ASPHALT

BACKGROUND OF THE INVENTION

The present invention relates to the production of asphalt; more particularly, it relates to methods for producing high quality, homogeneous asphalt from hydrocarbon feedstocks not normally suited for asphalt production.

Asphalts are defined as dark brown to black cementitious materials, solid or semisolid in consistency, in which the predominating constituents are bitumens which occur in nature or are obtained in petroleum processing (ASTM Designation D8). Asphalts comprise primarily very high molecular weight hydrocarbons called asphaltenes, with lesser amounts of resins, oils, waxes and other organics and inorganics.

Homogeneous asphalts, as compared to heterogeneous asphalts, are considered "purer" asphalts in that they are more uniformly constituted and generally have fewer impurities such as minerals and unwanted carbonaceous matter, such as carboids and carbenes or cracked hydrocarbons, which may affect the stability, ductility and temperature susceptibility of the asphalt. A homogeneous asphalt is, therefore, a more stable and preferred asphalt. Homogeneity is determined by the well-known "Oliensis" spot test.

While some asphalts may be utilized as taken from the ground, the overwhelming percentage are produced as products from petroleum processing. The bulk of asphalt production comes from the distillation of crude oils. These asphalts are called "straight-run" asphalts, and are obtained as residues from the physical separation of the heavier molecular weight, lower boiling point constituents of crudes from the lighter, more volatile parts. Crude oils comprising greater than 30% asphaltenes can generally be distilled in an atmospheric distillation unit to produce useable asphalts as the bottoms residue. The residues from crudes comprising less than 30% asphaltenes, however, are not immediately suitable and require further processing.

Residues from the distillation of crude oils comprising 15% to 30% asphaltenes can generally be redistilled a second time, usually through a vacuum or steam distillation unit, to remove more of the lighter materials to therby produce asphalts. Residues from the distillation of crude oils comprising less than 15% asphaltenes may be run through a propane deasphalting unit whereby small amounts of asphalt are precipitated from the residue by the treatment with propane under controlled conditions.

Straight-run asphalts are generally used in the paving industry where they serve as binders in paving mixes and as bases in liquid asphalts used as seal coatings, surface treatments, road mixes and soil stabilizers.

Some asphalts are produced by air-blowing fluid, semisolid or solid "straight-run" asphaltic residues produced by the various distillation processes. Air-blowing is a process by which air or other oxygen containing gases are passed through the asphaltic residues of elevated temperatures to harden them to a desired quality. It is believed that the oxyen chemically reacts with the hydrocarbons through the dehydrogenation and condensation of unsaturated linkages within the hydrocarbon molecules and polymerization of some of the lower molecular weight molecules to increase their molecular weights and generate more asphaltenes. These chemical changes alter the rheological properties of the asphalt to produce a harder material. Air blown asphalts are primarily used in the roofing and asphalt specialties industries.

Smaller amounts of asphalt are produced synthetically from a variety of processes, most particularly from the thermal cracking of heavier hydrocarbons. Some asphalts are also produced from the blending of two or more residues to produce an intermediate grade of asphalt, such as the blending of the resiny residues from the refinery processing of lubricating oils and the hard asphaltic residues from catalytic cracking-feed decarbonization operations to produce a desired intermediate grade of asphalt. The synthetic and blended asphalts are primarily used in the asphalt specialties industries.

The processes described above generally require feedstocks having a high asphaltene content, greater than 10% by weight, and a low wax content. Few processes, however, are capable of producing a high quality, homogeneous asphalt from crude oils or residues not normally suited for asphalt production, such as those that are paraffinic, non-asphaltic or low asphaltic, and waxy. Paraffinic hydrocarbons characteristically comprise lighter molecular weight molecules, while asphalts comprise primarily heavier molecular weight asphaltenes. Nonasphaltic or low asphaltic oils and residues also lack the main asphalt constituents, asphaltenes, and other heavier molecular weight molecules more easily convertible into asphaltenes. Waxy oils and residues produce brittle and otherwise unsuitable asphalts.

One process whereby low asphaltene content petroleum residues, that is those with less than 10% by weight asphaltenes, may be utilized to produce asphalts is disclosed in U.S. Pat. No. 2,220,714. The process therein consists of air-blowing distillation residues having less than 10% by weight asphaltenes and sulfur for 0.5 to 10 hours at a temperature of from 300° F. to 550° F., then removing the volatile oils from the air-blown residue and blending the remainder with a high boiling point hydrocarbon rich in resins to produce the desired asphalt. The quantity of sulfur used therein may vary from 0.5% to 5% by weight, but is preferably from 1% to 3% by weight.

U.S. Pat. No. 4,440,579 also discloses a process whereby less desirable crude stocks may be used to produce asphalts. The process therein consists of air-blowing petroleum residues in the presence of an organic sulfonic acid catalyst for a period of from 0.5 to 12 hours at a temperature of 400° F. to 550° F. The quantity of organic sulfonic acid catalyst employed may vary from 0.25% to 10% by weight.

With the present threats of oil shortages and resultant research into production of higher value fuels from less desirable feedstocks, including the asphaltic residuums, the present feedstocks and supply of asphalt are dwindling. In sharp contrast, the demand for asphalt is ever on the rise due to increased road and housing construction. Because of the dwindling supply and increasing demand, new feedstocks for the production of asphalt, new methods for producing asphalt and new supplies of asphalt in general are required to meet this impending need. It is, therefore, an object of the present invention to provide a method whereby high quality, homogeneous asphalts may be produced from alternate hydrocarbon feedstocks, namely those not ordinarily suited for asphalt production.

SUMMARY OF THE INVENTION

In accordance with the present invention, a method is provided for producing high quality, homogeneous asphalt from hydrocarbon feedstocks not normally suited for asphalt production. The method, in its overall concept, comprises the steps of mixing the hydrocarbon feedstock with sulfur and agitating the resulting mixture for from about 15 minutes to about 6 hours, more preferably from about 15 minutes to about 4 hours, at a temperature of form about 250° F. to about 550° F. The sulfur may be naturally occurring in the crude or all, or part, of the sulfur may be added to the crude. When sulfur is added to the hydrocarbon feedstock it can be either liquid or solid elemental sulfur, preferably liquid, and is added in an amount such that up to about 15% by weight sulfur is present. The mixture may be agitated in an open or closed vessel, at sub-atmospheric, atmospheric or super-atmospheric pressures, preferably atmospheric, using any conventional agitation device or method.

To promote the reactions of the hydrocarbon feedstocks with the sulfur, a catalyst which produces a free radical halide, preferably a metal halide catalyst, more preferably an alkali metal halide catalyst, still more preferably an alkali metal iodide, most preferably potassium iodide, may be added in amounts up to about 0.1% by weight. The resulting agitated mixture may be air blown in any one of a number of conventional manners by heating the agitated mixture to a temperature of about 250° F. to about 550° F. and contacting air or other oxygen containing gas with the agitated mixture until the desired hardness is obtained.

DETAILED DESCRIPTION OF THE PREFERRED EMBODIMENT

The present invention provides a method of producing high quality, homogeneous asphalt from alternative hydrocarbon feedstocks,that is, from hydrocarbon feedstocks not normally suitable for asphalt production. Such hydrocarbon feedstocks may have low asphaltene or no asphaltene content, that is, less than abut 15% by weight asphaltenes, and be paraffinic and waxy yet still be suited for the process herein described.

The method, in its overall concept, comprises the steps of mixing the hydrocarbon feedstock with sulfur and agitating the resulting mixture for from about 15 minutes to about 6 hours, more preferably from about 15 minutes to about 4 hours, at a temperature of from about 250° F. to about 550° F. The sulfur may be naturally occurring in the feedstock or all, or part, may be added thereto. When sulfur is added to the hydrocarbon feedstock it can be either liquid or solid elemental sulfur, preferably liquid, and is added in an amount to result in the presence of up to about 15% by weight sulfur. The mixture may be agitated in an open or closed vessel, at sub-atmospheric, atmospheric or superatmospheric pressures, and using any conventional agitation device or method. Preferably, however, the agitation is performed under atmospheric conditions.

The agitation time, temperature and sulfur concentration depend upon the characteristics of the hydrocarbon feedstock and the quality of asphalt desired. Due to the wide applicability of this invention with respect to a wide variety of hydrocarbon feedstocks, a wide range of conditions are possible and suitable. For example, paraffinic or waxy feedstocks generally require greater amounts of sulfur, higher reaction temperatures and longer reaction periods to produce the desired quality asphalt than heavier feedstocks. The lighter molecular weight components require greater amounts of conversion to become asphaltenes, and the higher sulfur addition, higher reaction temperatures and longer reaction periods are all directed toward this end. Likewise, to produce a harder asphalt more asphaltenes must be generated and, therefore, higher sulfur addition, higher reaction temperatures and longer reaction periods are utilized.

The sulfur is believed to react with the hydrocarbons through a mechanism similar to that of the aforedescribed oxygen reaction, in that the dehydrogenation and condensation of unsaturated linkages and polymerization of some of the molecules produce higher molecular weight molecules. One main difference between the two is that water is a by-product of the oxygen reaction while hydrogen sulfide is a by-product of the sulfur reaction. The hydrogen sulfide, however, is not produced in large amounts without an excess of sulfur, and further the noxious odor and ease of detecting of hydrogen sulfide gas can be used as a means for determining when excessive sulfur is present in the system or the rate of sulfur addition is too high. The smell of hydrogen sulfide gas by an operator or the detection of its presence by any one of a number of conventional detection devices would be an indication to reduce the amount or rate of sulfur added to the system. This reaction control is important because an overabundance of sulfur could produce a product too hard for practical use. In fact, if the softening point of the product is too high, it will be extremely difficult to even remove from the reactor.

Some hydrocarbons, however, react slowly with the sulfur, especially the lighter hydrocarbons, and especially so at the lower temperature ranges. Even at the higher temperature ranges the reactions may still proceed very slowly, so a catalyst may be employed to promote the reaction. The preferred catalyst comprises a catalyst which produces a free radical halide, preferably a metal halide catalyst, more preferably an alkali metal halide catalyst, still more preferably an alkali metal iodide catalyst, most preferably potassium iodide, which may be added in an amount up to about 0.1% by weight during the mixing of the hydrocarbon feedstock and sulfur.

Once again the agitation time, temperature and sulfur concentration depend upon the characteristics of the hydrocarbon feedstock and the quality of the asphalt desired, as detailed above. Also the catalyst concentration depends upon these same considerations, since a higher catalyst concentration will promote the reaction rate between the sulfur and hydrocarbon feedstocks, thereby resulting in more reactions and more asphaltenes being produced.

As previously mentioned, a wide variety of hydrocarbon feedstocks are suited for the present invention, such as, but not limited to, non-asphaltic or low asphaltic crude oils, paraffinic crudes, distilled heavy gas oil with and without asphaltenes, aromatic crudes and whole crudes, all with or without waxes. The feedstocks may also contain sulfur which is to be taken into account in practicing the invention. For example, asphalt has been produced by the present invention from hydrocarbon feedstocks including 40 weight motor oil having no asphaltenes and Salt Lake heavy crude which was waxy, contained about 13% by weight sulfur and about 26% by weight brine, and had an API gravity of about 5°. It is preferred, however, that the hydrocarbon feedstock have less than about 4%, and more preferably less than about 3%, by weight free carbon, since the free carbon will react with the sulfur to produce an undesirable hard residue which can result in a brittle or heterogeneous asphalt.

The product from the reaction of the hydrocarbon feedstock and sulfur, absent or with the catalyst, may be of the quality desired or may further be tailored by air blowing in any one of a number of conventional manners. Air blowing, as previously mentioned, is the process by which air or other oxygen containing gases are passed through asphaltic residues to oxidize them and thereby increase their hardness. The physical properties of a particular asphalt during or at the end of the processing can be determined by well known means to consider if more processing is necessary.

If the asphalt is too soft and it is desired to air blow the product from the agitation reaction to increase its hardness, it is preferred that such product have a flash point of at least about 550° F., and more preferably at least about 600° F. The flash point of the product may be raised by pre-flashing or distilling off the lighter products prior to the air blowing. Once the desired flash point is obtained, the product is heated to a temperature of about 250° F. to 550° F. and air or other oxygen containing gas is thereby blown through the product in any conventional manner until the desired hardness is obtained, generally for from about 15 minutes to about 4 hours, but longer if necessary. A steam purge for purging residual lights may also be utilized for safety reasons.

The foregoing more general discussion of this invention will be further exemplified by the following specific examples offered by way of illustration and not limitation of the above-described invention.

EXAMPLE 1

The residue from the vacuum distillation of a waxy, paraffinic crude used to make lubricating oil was here utilized. The crude had a high wax and paraffin content and a low concentration of asphaltenes, and was not suitable for asphalt production by conventional means.

The residue was mixed with 10% by weight elemental sulfur and 0.05% by weight potassium iodide, and agitated in an open vessel equipped with a mixer under atmospheric conditions at a temperature of 450° F. for 3 hours. No air blowing was performed.

The resulting product was a hard asphalt having a penetration value of 10, indicating a high degree of hardness. While a 10 penetration asphalt is too hard for most uses, a more suitable asphalt can be produced by varying the reaction conditions, as is shown by Example 2.

EXAMPLE 2

The same residue from the vacuum distillation of the waxy, paraffinic crude used to make lubricating oil was again utilized. The residue was this time mixed with 5% by weight elemental sulfur and 0.01% by weight potassium iodide, agitated under atmospheric conditions at 350° F. for 3 hours as in Example 1, then air blown at 350° F. for 1 hour.

The resulting product was a high quality asphalt having a penetration at 77° F. of 230 (ASTM D-5), a ductility at 77° F. of 110+ (ASTM D-133), a 99.79% solubility in carbon tetrachloride, and a negative Olienses spot test indicating homogeneity.

As can be seen from Examples 1 and 2, different reaction conditions produce different quality asphalts. A higher percentage of sulfur added will produce more reactions and, therefore, more asphaltenes and a harder asphalt. Increasing the agitation time will also have a similar effect, since more time is allowed for more reactions to take place. Increasing the reaction rate by catalyst addition and increased temperatures will also allow more reactions. A desired quality asphalt can, therefore, be produced by altering the above variables and, if required, by air-blowing the agitated product.

EXAMPLE 3

A 40 weight motor oil having no free carbon and no asphaltenes was here utilized. To this oil was added 15% by weight sulfur and 0.1% by weight potassium iodide crystals. The resulting mixture was agitated under atmospheric conditions at a temperature of 400° F. No air blowing was performed.

A semisolid mass which would hold its shape was produced, which indicated asphalt production.

Those skilled in the art will be able to make variations of this invention from the foregoing description and examples without departing from the scope and spirit of the claimed invention.

I claim:

1. A method of producing asphalt from low asphaltene content, paraffinic or waxy hydrocarbon feedstock, comprising the steps of:

mixing said hydrocarbon feedstock with elemental sulfur to produce a mixture including elemental sulfur, wherein said mixture comprises up to about 15% by weight elemental sulfur; and heating while agitating said mixture, without air blowing, at a temperature of between about 250° F. to about 550° F. for from about 15 minutes to about 6 hours to generate asphaltenes, thereby producing asphalt.

2. The method of claim 1, wherein said mixing and heating while agitating steps are performed under atmospheric pressure.

3. The method of claim 1, wherein said hydrocarbon feedstock comprises less than about 4% by weight free carbon.

4. The method of claim 3, wherein said hydrocarbon feedstock comprises less than about 3% by weight free carbon.

5. The method of claim 1, wherein said hydrocarbon feedstock has less than about 15% by weight asphaltenes.

* * * * *